US007575473B2

(12) United States Patent
Kodama et al.

(10) Patent No.: US 7,575,473 B2
(45) Date of Patent: Aug. 18, 2009

(54) CONNECTOR

(75) Inventors: Shinji Kodama, Shizuoka (JP); Sumito Atsumi, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 12/149,667

(22) Filed: May 6, 2008

(65) Prior Publication Data

US 2008/0305672 A1 Dec. 11, 2008

(30) Foreign Application Priority Data

Jun. 8, 2007 (JP) ..... 2007-152379

(51) Int. Cl.
*H01R 13/73* (2006.01)

(52) U.S. Cl. ..... 439/563; 439/549; 439/372; 439/538

(58) Field of Classification Search ..... 439/562–564, 439/538, 549, 372
See application file for complete search history.

(56) References Cited

U.S. PATENT DOCUMENTS 5,279,507 A * 1/1994 Kameyama ..... 439/552

FOREIGN PATENT DOCUMENTS

JP 2000-348830 12/2000
JP 2003-338346 11/2003
JP 2005-259553 9/2005

* cited by examiner

*Primary Examiner*—Truc T Nguyen
(74) *Attorney, Agent, or Firm*—Edwards Angell Palmer & Dodge LLP

(57) ABSTRACT

A connector is provided, by which deformation or damage of a locking arm is prevented, a secure holding force of the locking arm is assured, and the connector is stably held in a hole of a panel. The connector includes: a first connector housing to be allowed to pass through a hole of a panel; a locking arm formed on the first connector housing, the locking arm being resiliently deformed to be locked to an inner edge of the hole when the first connector housing is allowed to pass through the hole; a second connector housing to be fit to the first connector housing; and a displacement preventing means for preventing the locking arm from being displaced in a direction crossing a direction in which the locking arm is resiliently deformed.

4 Claims, 18 Drawing Sheets

CONNECTOR

BACKGROUND OF THE INVENTION (1) Field of the Invention

The present invention relates to a connector including a first connector housing, a locking arm formed on the first connector housing, and a second connector housing, in which the second connector housing is fit to the first connector housing locked in a hole of a panel.

(2) Description of the Related Art

A wiring harness for use in a motor vehicle as a mobile unit includes a connector having a pair of connector housings which fits to each other on a condition that the pair of the connector housings puts a panel constructing a vehicle body therebetween. That is, the panel is positioned between the pair of the connector housings. The panel is provided with a hole which lets the pair of the connector housings pass therethrough.

Such a connector is known, in which one connector housing (hereinafter, first connector housing) is fit to another connector housing (hereinafter, second connector housing) on a condition that the first connector housing is locked in a hole of a panel (for example, see Japanese Patent Application Laid-Open 2005-259553, Japanese Patent Application Laid-Open 2000-348830, and Japanese Patent Application Laid-Open 2003-338346). The connector includes: the first connector housing, which is allowed to pass through the hole of the panel; a locking arm, which is formed on the first connector housing and locked to an inner edge of the hole; and the second connector housing, which is fit to the first connector housing.

When the first connector housing is allowed to pass through the hole, the locking arm is resiliently deformed in a direction, in which the locking arm approaches the first connector housing, and locked to the inner edge of the hole, so that the first connector housing is locked and held in the hole of the panel. At that time, the first connector housing is held having a certain looseness between the first connector housing and the panel so that the first connector housing is easily fit to the second connector housing with absorbing a positional shift when first connector housing is being fit to the second connector housing. Thereafter, a worker lightly pulls the held first connector housing in a direction reverse to the insertion direction of the first connector housing so as to confirm whether or not the first connector housing is securely held in the hole of the panel.

However, since there is the looseness between the first connector housing and the panel, therefore the worker possibly might pull the first connector housing in a direction crossing the direction reverse to the insertion direction of the first connector housing (for example, in an oblique upper direction) when the worker pulls the first connector housing in the direction reverse to the insertion direction of the first connector housing.

When the first connector housing is pulled in the oblique upper direction, the locking arm is affected by a force in an oblique upper direction, that is, in a direction crossing the direction in which the locking arm is resiliently deformed on a condition that the locking arm is locked to the panel. Therefore, when the locking arm is largely deformed in said direction, the locking arm is affected by an excess stress causing a problem that the locking arm is twisted so as to be permanently deformed or damaged.

Once the locking arm is permanently deformed or damaged, the locking arm cannot serve a sufficient holding force causing a problem that the first connector housing cannot be stably held in the hole of the panel and cannot be properly fit to the second connector housing and therefore, terminal fittings received in the respective connector housings cannot be electrically connected to each other.

SUMMARY OF THE INVENTION

It is therefore an objective of the present invention to solve the above problem and to provide a connector, by which the deformation or damage of the locking arm is prevented from occurring, a secure holding force of the locking arm is assured, and the connector is stably held in the hole of the panel.

In order to attain the above objective, the present invention is to provide a connector including:

a first connector housing to be allowed to pass through a hole of a panel;

a locking arm formed on the first connector housing, the locking arm being resiliently deformed to be locked to an inner edge of the hole when the first connector housing is allowed to pass through the hole;

a second connector housing to be fit to the first connector housing; and a displacement preventing means for preventing the locking arm from being displaced in a direction crossing a direction in which the locking arm is resiliently deformed, wherein the locking of the locking arm to the hole is removed when the second connector housing is fit to the first connector housing locked in the hole, the first connector housing is prevented from moving relatively with respect to the panel until the first and second connector housings are fit to each other, and the first connector housing moves relatively with respect to the panel when the first and second connector housings are fit to each other, so that the second connector housing is locked in the hole.

With the construction described above, the displacement preventing means considerably prevents the locking arm from being displaced in the direction crossing the resilient deformation direction of the locking arm even when the first connector housing is pulled in the direction crossing the resilient deformation direction of the locking arm. That is, the locking arm is kept from an excess stress. Therefore, the locking arm can secure a sufficient holding force without being deformed or damaged, so that the first connector housing is stably held in the hole of the panel. That is, the first connector housing can properly fit to the second connector housing and therefore, terminal fittings of the respective connector housings can securely electrically connected to each other.

The connector further includes a first projection formed on one of the displacement preventing means and the locking arm, the first projection projecting from the one toward another of the displacement preventing means and the locking arm.

With the construction described above, when the first connector housing is pulled in the direction crossing the resilient deformation direction of the locking arm and the locking arm is to be displaced to said crossing direction, the first projection abuts against the displacement preventing means (or against the locking arm), so that the locking arm is considerably prevented from being displaced. That is, the locking arm is kept from an excess stress. Therefore, the locking arm can secure a sufficient holding force without being deformed or damaged, so that the first connector housing is stably held in the hole of the panel.

The connector further includes a second projection formed on the locking arm, the second projection projecting from the locking arm toward an inner surface of the hole.

With the construction described above, when the first connector housing is pulled in the direction crossing the resilient deformation direction of the locking arm and the locking arm is to be displaced to said crossing direction, the second projection abuts against the inner surface of the hole, so that the locking arm is considerably prevented from being displaced in a direction in which the locking arm approaches the inner surface of the hole. The locking arm is securely displaced in a direction, in which the locking arm approaches the displacement preventing means, and abuts against the displacement preventing means. Therefore, the locking arm can secure a sufficient holding force without being deformed or damaged, so that the first connector housing is stably held in the hole of the panel.

DESCRIPTION OF THE PREFERRED EMBODIMENTS

Figure 1:
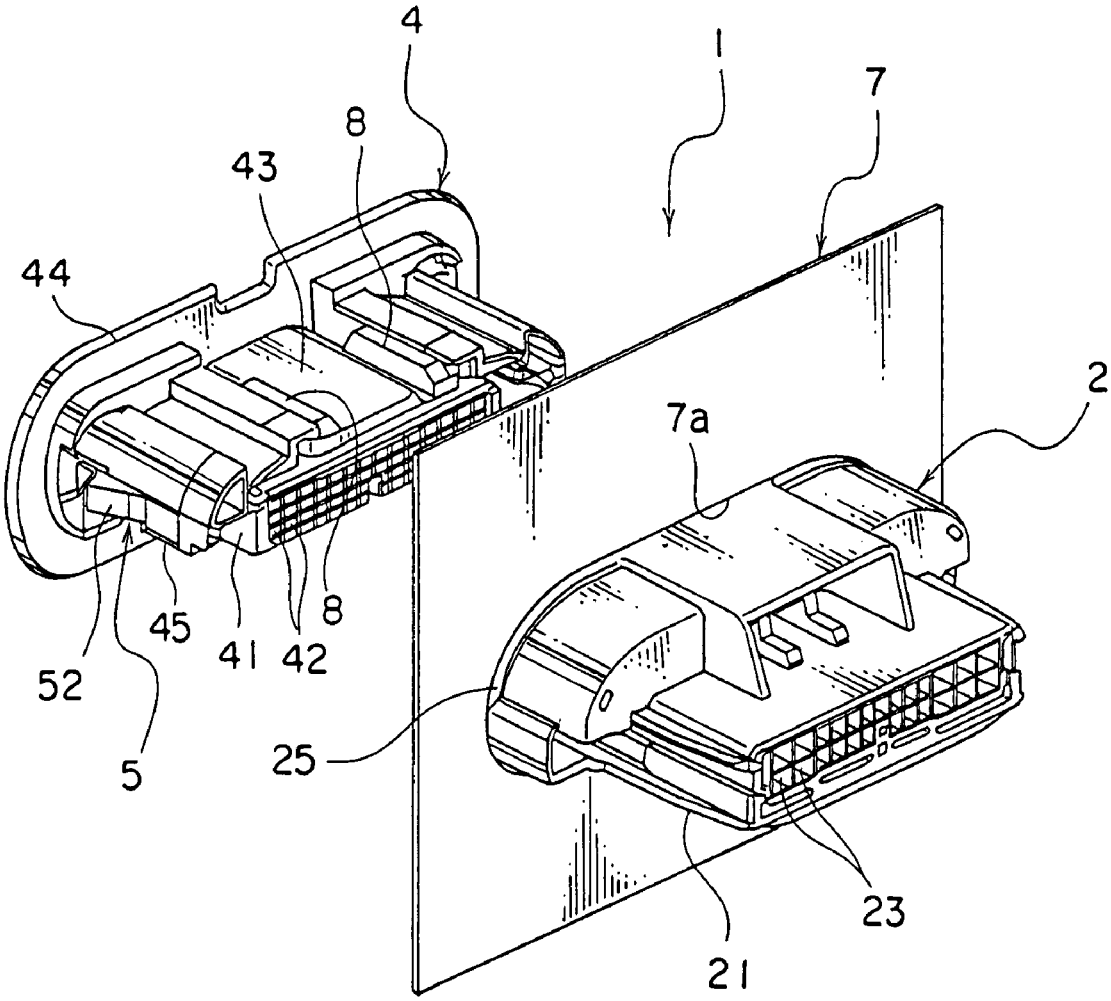
FIG. 1 is a perspective view illustrating a connector according to a preferred embodiment of the present invention and a body panel.
Figure 2:
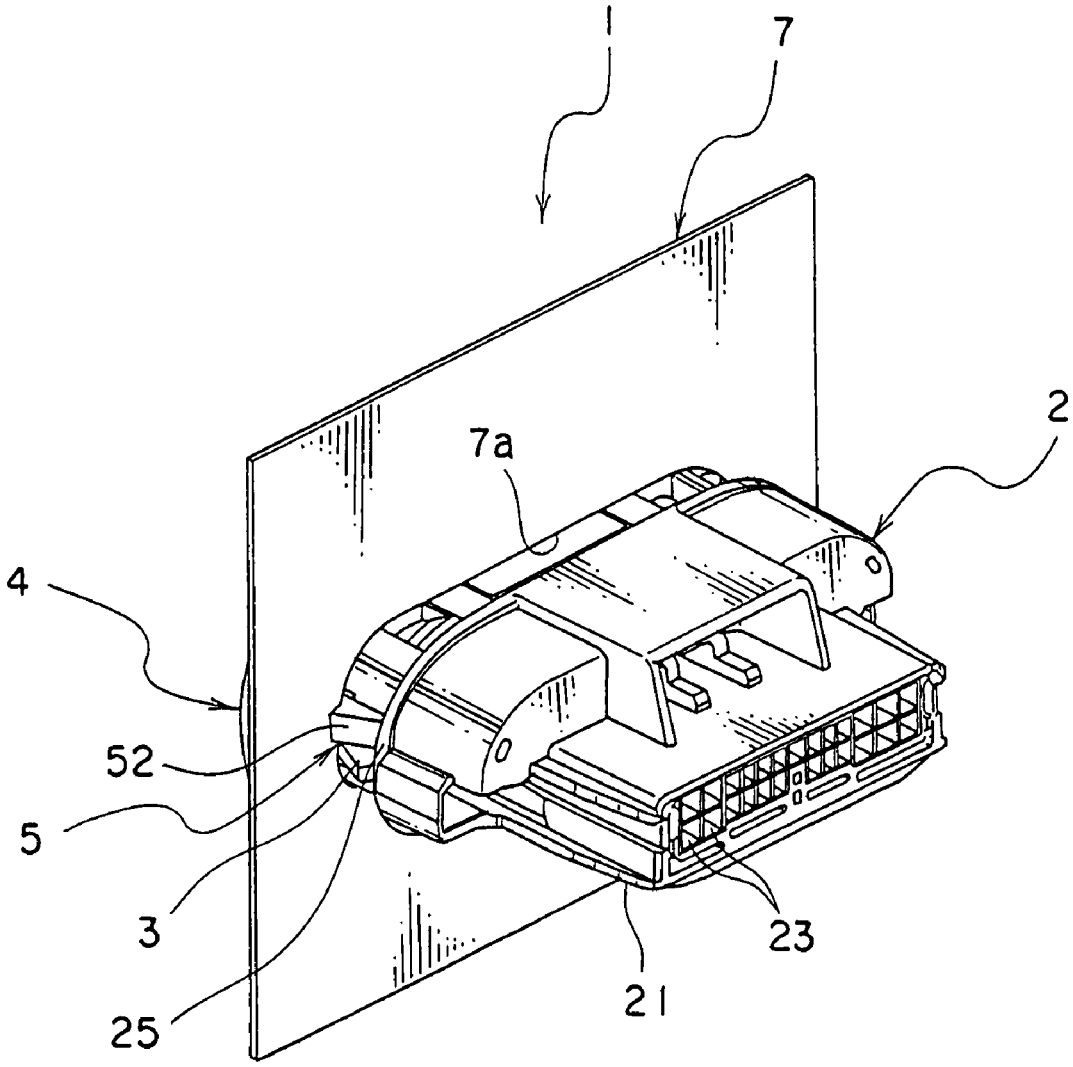
FIG. 2 is a perspective view illustrating a state when the connector shown in FIG. 1 is assembled to the body panel.

In the following, a connector 1 according to a preferred embodiment of the present invention will be explained with reference to FIGS. 1-18. The connector 1 constructs a wiring harness to be mounted on a motor vehicle or the like. As shown in FIGS. 1 and 2, the connector 1 includes: a first connector housing 2 and a second connector housing 4 fit to each other positioning a body panel 7, which constructs a vehicle body, therebetween; a locking arm 3 (see FIG. 2); and a grommet (not shown in the figure).

Figure 3:
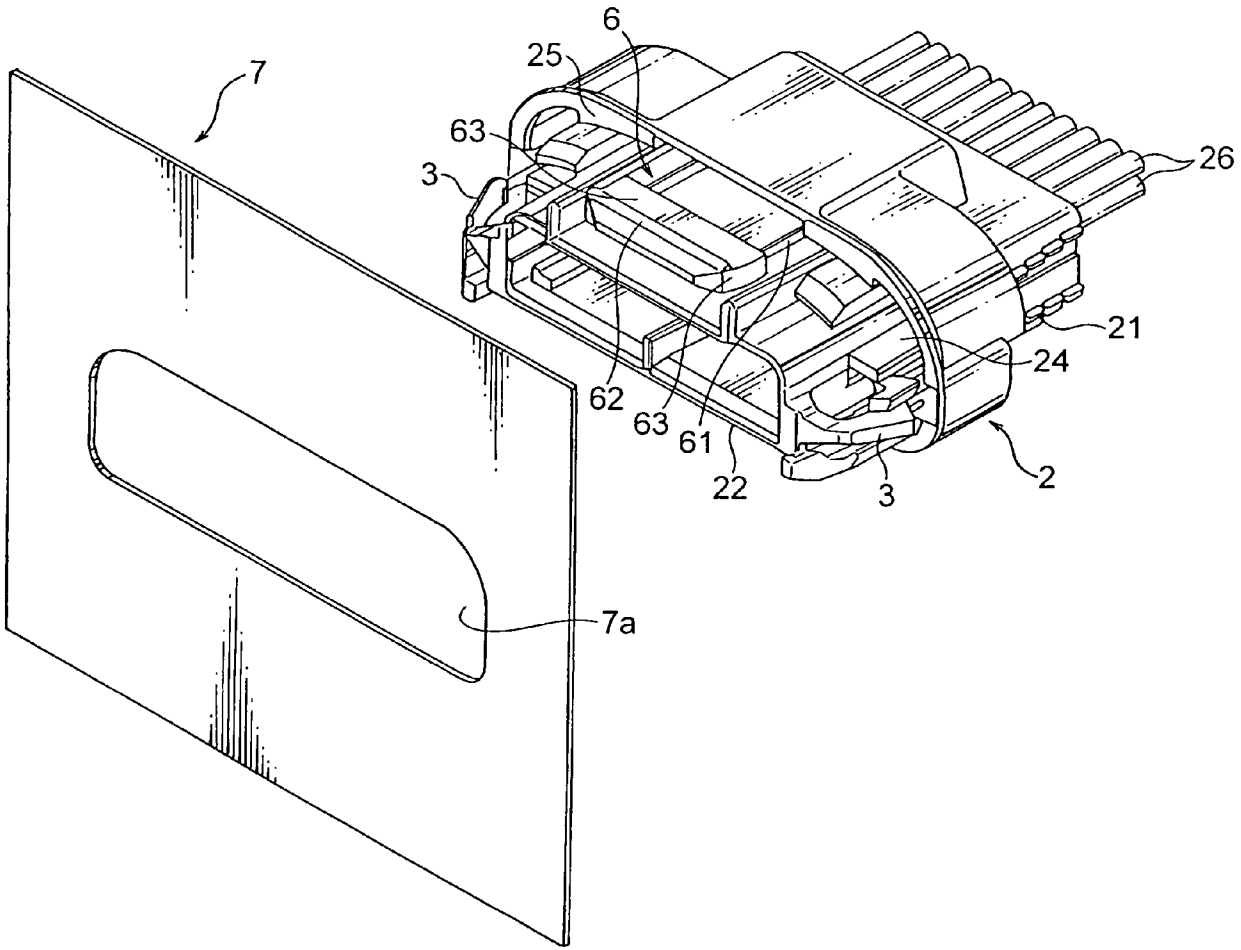
FIG. 3 is a perspective view illustrating a state before the first connector housing shown in FIG. 1 is locked to the body panel.
Figure 4:
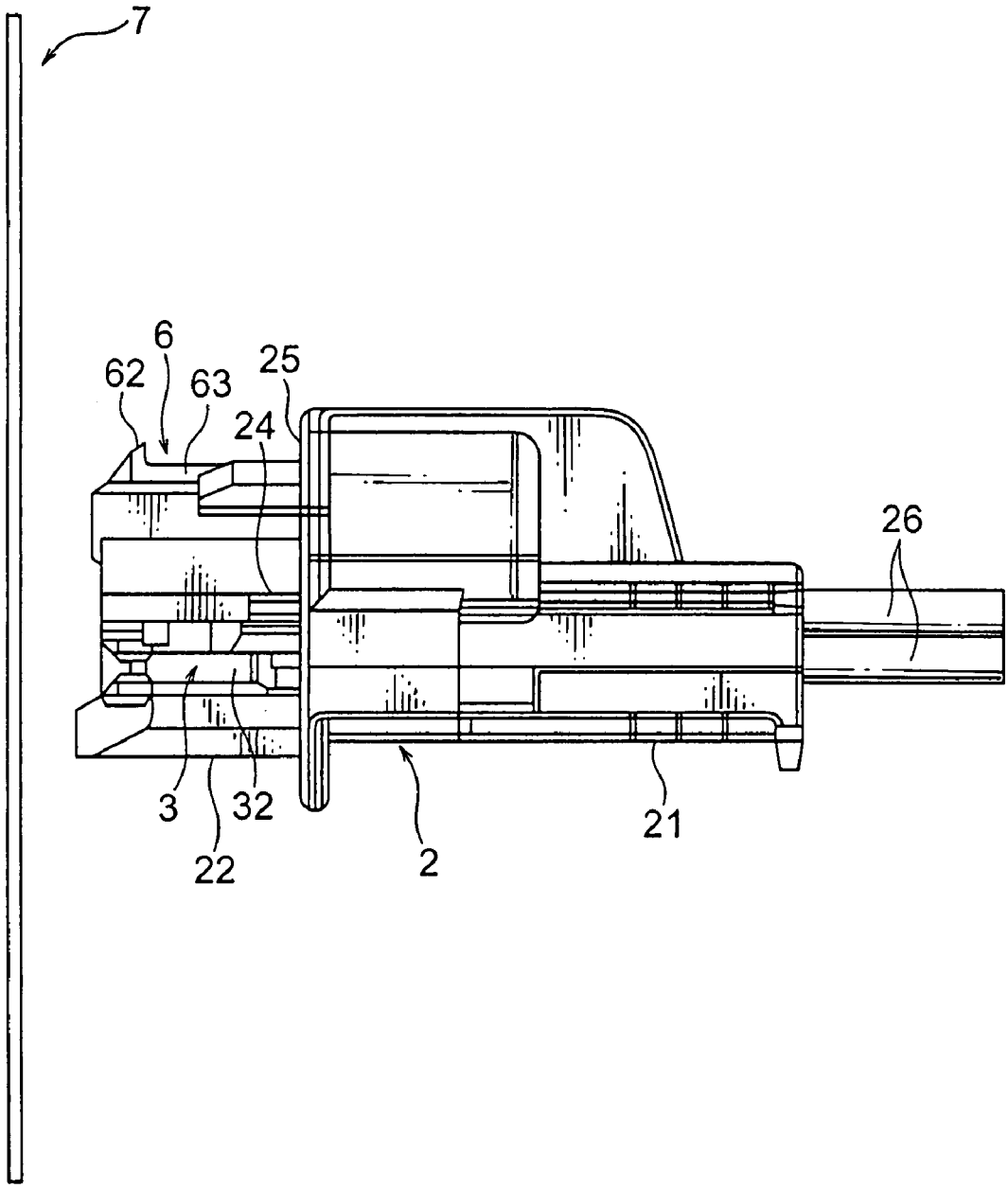
FIG. 4 is a side view of the first connector housing and the body panel shown in FIG. 3.

As shown in FIG. 3, the body panel 7 is provided with a hole 7*a* penetrating through the body panel 7. The first and second connector housings 2, 4 fit to each other allowing a male hood part 22 and body part 41 (explained later) to pass through the hole 7*a*. At that time, the first and second connector housings 2, 4 fit to each other approaching each other along a direction parallel to a longitudinal direction of terminal receiving chambers 23, 42 (explained later). That is, the first and second connector housings 2, 4 position the body panel 7 therebetween and are allowed to pass through the hole 7*a* of the body panel 7 so as to fit to each other. At that time, the first and second connector housings 2, 4 are fixed to the body panel 7.

Figure 5:
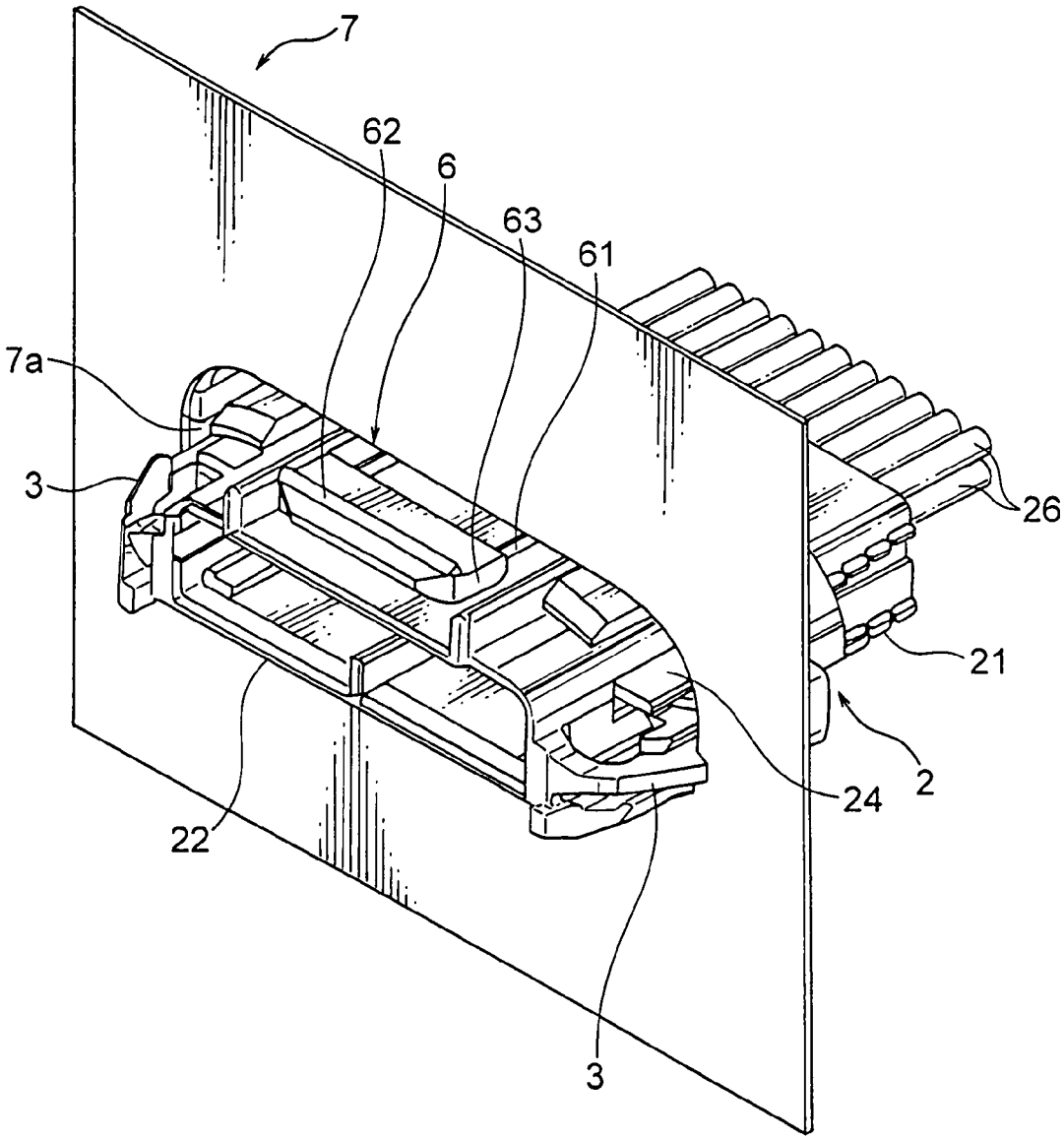
FIG. 5 is a perspective view illustrating a state when the first connector housing shown in FIG. 3 is locked to the body panel.
Figure 6:
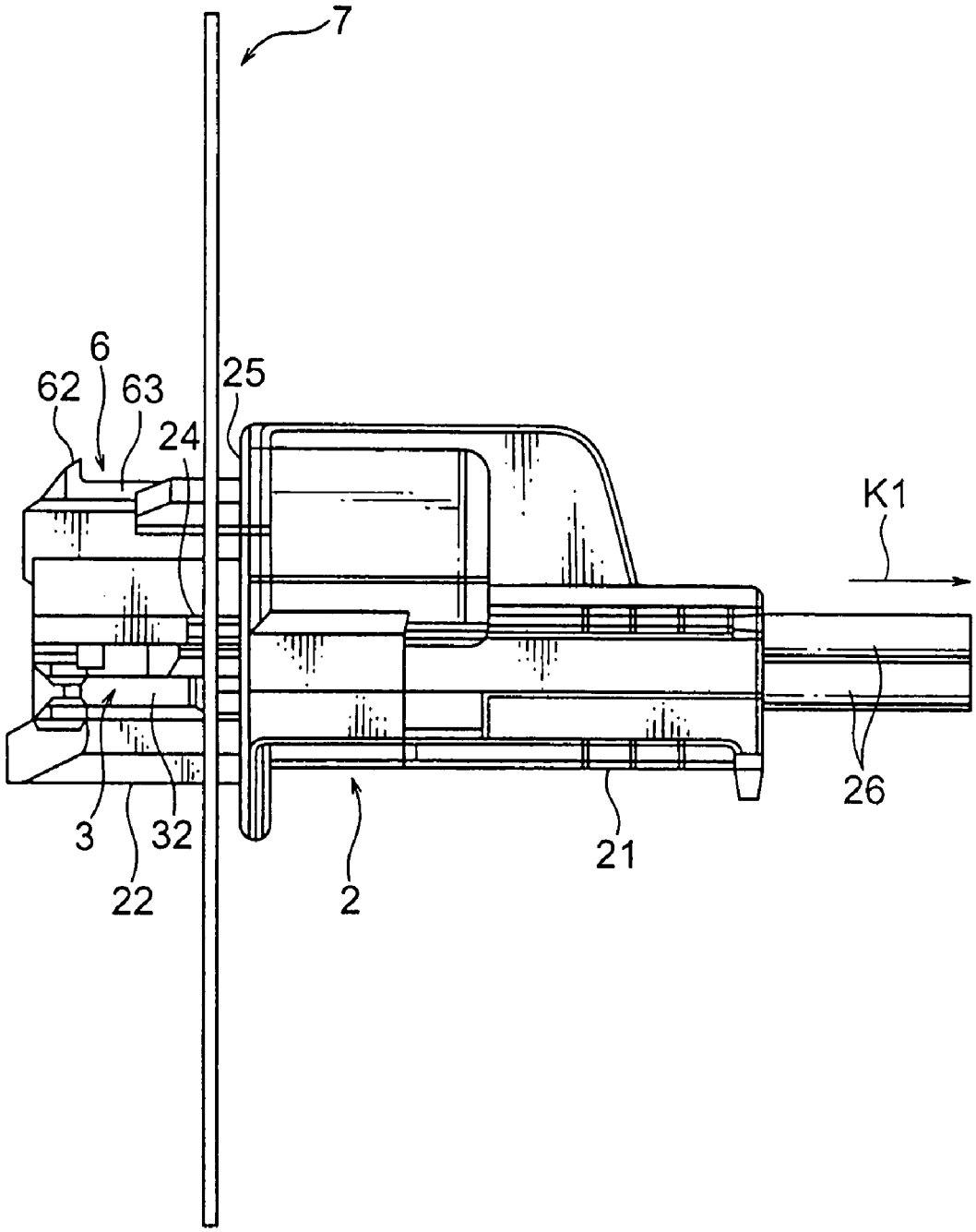
FIG. 6 is a side view of the first connector housing and the body panel shown in FIG. 5.

As shown in FIGS. 5 and 6, the first connector housing 2 is allowed to pass through the hole 7*a* of the body panel 7. The first connector housing 2 includes a box-shaped receiving part 21 receiving a male terminal fitting 23*a* (hereinafter, male terminal 23*a*), tube-shaped male hood part 22 continuing to the receiving part 21, rib 24 (the displacement preventing means), flange 25 (see FIG. 6), and locking arm 6.

Figure 12:
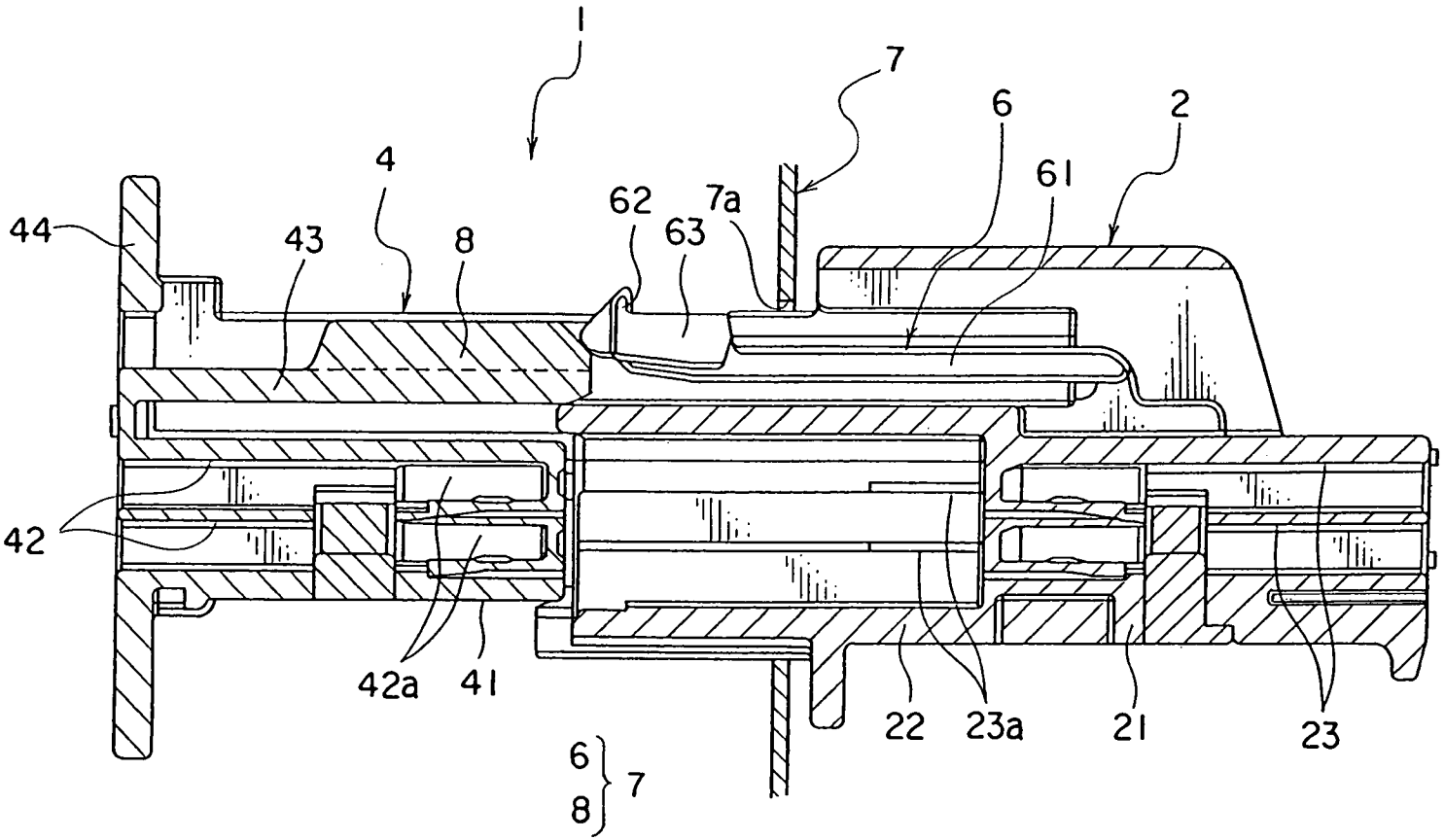
FIG. 12 is a cross sectional view illustrating a state when the first and second connector housings shown in FIG. 1 start to fit to each other.
Figure 13:
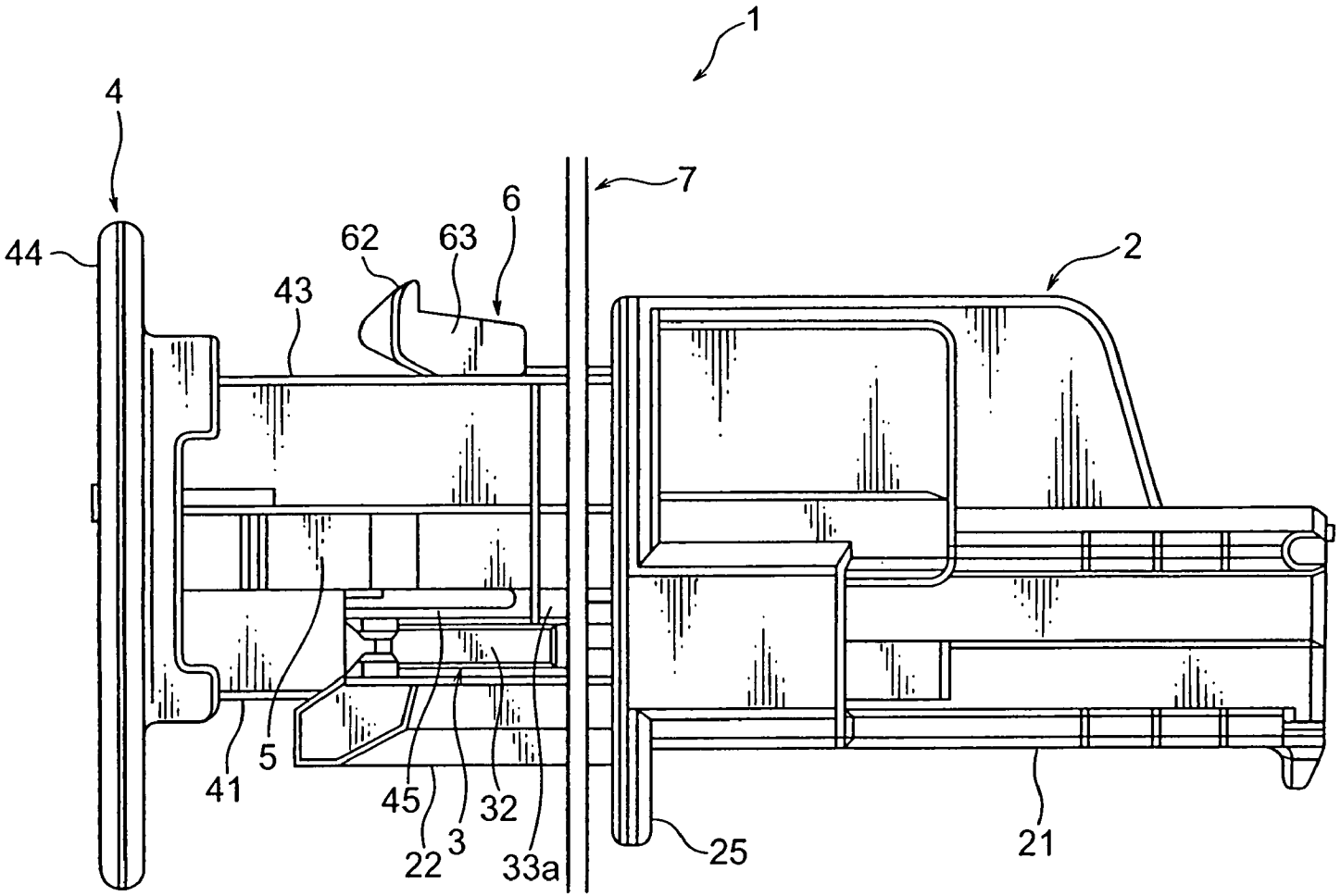
FIG. 13 is a side view illustrating a state when the first and second connector housings shown in FIG. 12 further fit to each other so that the locking of the locking arm is removed.

The receiving part 21 and the male hood part 22 are arranged along an axial direction of the first connector housing 2. As shown in FIG. 12, the receiving part 21 includes a plurality of terminal receiving chambers 23. Each terminal receiving chamber 23 is formed straight and arranged along the axial direction of the first connector housing 2. The terminal receiving chambers 23 are arranged in parallel to each other. The terminal receiving chamber 23 receives an electric wire connecting part of the male terminal 23*a* therein. The electric wire connecting part is connected to an electric wire 26 (see FIG. 3) which is guided out from an opening located away from the male hood part 22 of the receiving part 21.

An electric contact part of the male terminal 23*a* projects in the male hood part 22. When the first and second connector housings 2, 4 fit to each other, a body part 41 of the second connector housing 4 is inserted in the male hood part 22. Then, the electric contact part of the male terminal 23*a* enters an electric contact part of a female terminal fitting 42*a* (hereinafter, female terminal 42*a*) received in the body part 41, so that the male terminal 23*a* and the female terminal 42*a* are electrically connected to each other.

Figure 10:
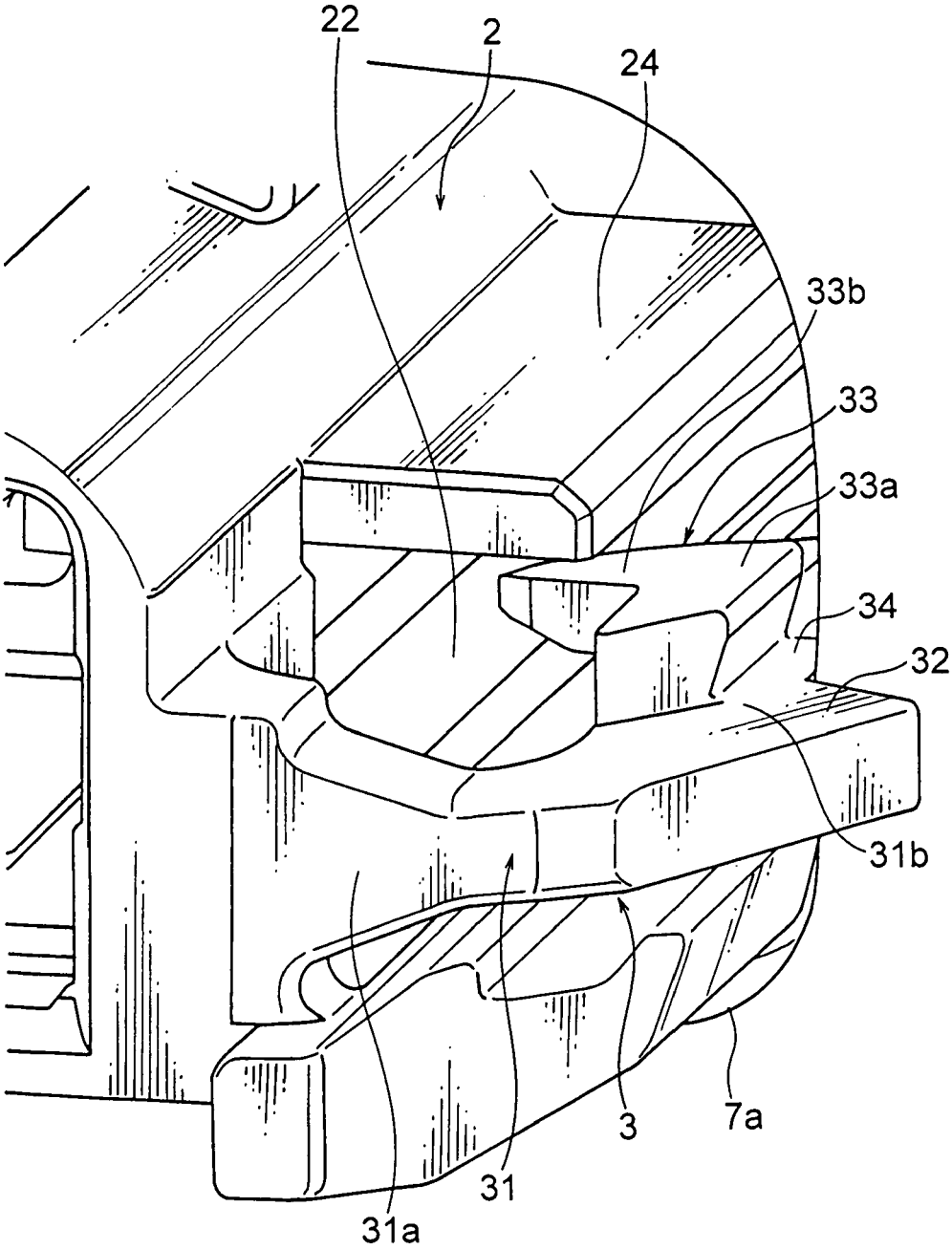
FIG. 10 is a perspective view of a primary part of the first connector housing shown in FIG. 9.

As shown in FIG. 10, the rib 24 projects from an outer surface of the male hood part 22 toward the outside of the male hood part 22 and extends in the axial direction of the first connector housing 2. The rib 24 is provided in the proximity of the locking arm 3. The rib 24 and the locking arm 3 are arranged lined up along a direction crossing at right angles a direction in which the locking arm 3 is resiliently deformed. The rib 24 is arranged between the locking arm 3 and an inner surface of the hole 7*a* of the body panel 7 in the direction crossing at right angles.

As shown in FIG. 3, the flange 25 projects from an outer surface of the male hood part 22 toward the outside of the male hood part 22. The flange 25 is provided throughout the entire periphery of the male hood part 22 near the receiving part 21. When the first connector housing 2 is locked in the hole 7*a* of the body panel 7, as shown in FIG. 6, the body panel 7 is positioned between the flange 25 and a locking projection 32 (explained later) of the locking arm 3 and between the flange 25 and a projection part 62 (explained later) of a lock arm 6.

As shown in FIG. 3, the lock arm 6 includes a lock arm body 61 formed on the male hood part 22, projection part 62, and lock part 63. The lock arm body 61 is formed in a band plate-shape and extends along the axial direction of the first connector housing 2. One end part of the lock arm body 61 near the male hood part 22 is a free end, while another end part of the lock arm body 61 near the receiving part 21 continues to an outer surface of the male hood part 22 of the first connector housing 2. That is, the lock arm body 61 extends from the first connector housing 2 toward the second connector housing 4 which is fit to the first connector housing 2.

The projection part 62 is provided on the one end part of the lock arm body 61. The projection part 62 projects from the one end part of the lock arm body 61 toward the outside of the second connector housing 4. When the first connector housing 2 is locked in the hole 7*a* of the body panel 7, as shown in FIG. 6, the body panel 7 is positioned between the projection part 62 and the flange 25.

The lock part 63 is provided on the one end part of the lock arm body 61. A pair of the lock parts 63 is arranged so as to position the lock arm body 61 therebetween. Each lock part 63 projects from the one end part of the lock arm body 61 toward a width direction of the lock arm body 61.

The lock arm 6 is resiliently deformable in a direction in which one end part of the lock arm body 61 approaches and leaves the male hood part 22. When the one end part of the lock arm body 61 is resiliently deformed in a direction leaving the male hood part 22, in particular an end part of the lock arm 6 is caught by an inner edge of the hole 7*a* of the body panel 7 so as to prevent the first connector housing 2 from moving relatively to the body panel 7. When the one end part of the lock arm 6 approaches the male hood part 22 so as to be in its initial state in which the one end part of the lock arm 6 is not resiliently deformed, in particular the end part of the lock arm 6 is not caught by the inner edge of the hole 7*a* of the body panel 7 and allows the first connector housing 2 to move relatively to the body panel 7.

The locking arm 3 is formed on the first connector housing 2 and is resiliently deformed so as to be locked to the inner edge of the hole 7*a* of the body panel 7. As shown in FIG. 10, the locking arm 3 includes an arm body 31 formed on the male hood part 22, and locking projection 32, first projection 33 and second projection 34 each being formed projecting from an outer surface of the arm body 31.

The arm body 31 extends along the axial direction of the first connector housing 2. One end part 31*a* of the arm body 31 near the male hood part 22 continues to an outer surface of the male hood part 22, while another end part 31*b* of the arm body 31 near the receiving part 21 is a free end. That is, the arm body 31 extends in a direction leaving the second connector housing 4, which fits to the first connector housing 2. The locking arm 3 is resiliently deformable in a direction in which the other end part 31*b* of the arm body 31 approaches the male hood part 22.

As shown in FIG. 10, the locking projection 32 is provided on the other end part 31*b* of the arm body 31. The locking projection 32 projects from the other end part 31*b* of the arm body 31 toward the outside of the first connector housing 2. The locking projection 32 is formed in a triangular shape in a plan view in such a manner that an amount of projection from the arm body 31 decreases as the locking projection 32 approaches the one end part 31*a* of the arm body 31. When the first connector housing 2 is allowed to pass through the hole 7*a* of the body panel 7, the arm body 31 is resiliently deformed, so that the locking projection 32 is locked to the inner edge of the hole 7*a* of the body panel 7. Then, as shown in FIG. 6, the body panel 7 is positioned between the locking projection 32 and the flange 25.

When the locking projection 32 is locked to the hole 7*a* of the body panel 7, the locking arm 3 is locked to the inner edge of the hole 7*a*. When the arm body 31 is resiliently deformed, the locking arm 3 makes the locking projection 32 be locked to the hole 7*a* or makes the locking be removed. On an initial condition that the arm body 31 is not resiliently deformed, the locking projection 32 is locked to the hole 7*a*. When the arm body 31 is resiliently deformed so that the locking projection 32 is locked to the hole 7*a*, thereby holding the first connector housing 2 in the hole 7*a*.

Figure 11:
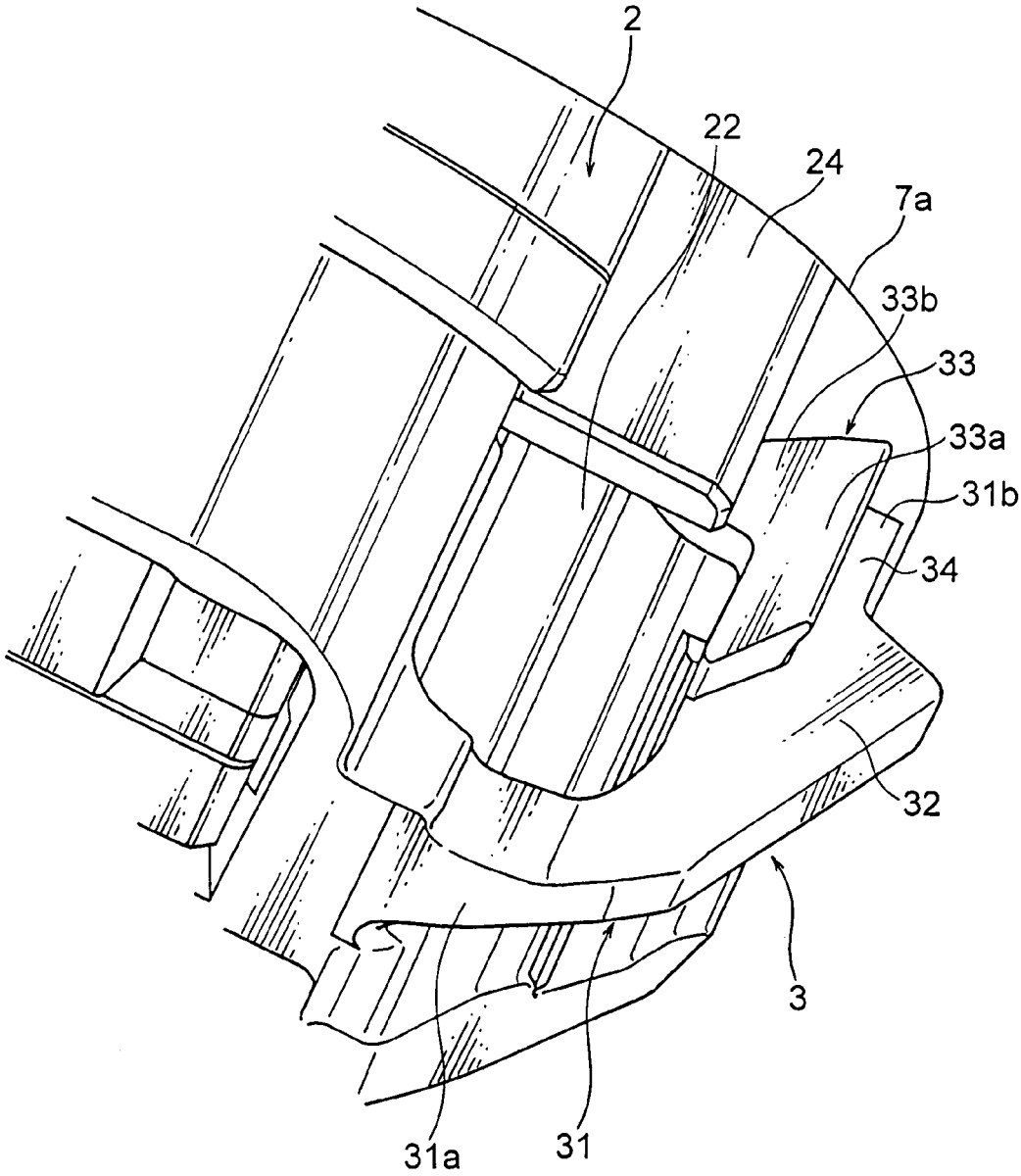
FIG. 11 is a perspective view of a primary part of the first connector housing shown in FIG. 9 viewed from another direction.

As shown in FIG. 11, the first projection 33 is provided on the other end part 31*b* of the arm body 31. The first projection 33 projects from an outer surface of the arm body 31 near the rib 24 toward the rib 24. The first projection 33 includes a base 33*a* and an abutting part 33*b* continuing to the base 33*a*.

The base 33*a* is formed in a rod-shape and provided along the longitudinal direction of the arm body 31. The base 33*a* is provided being placed on an outer surface of the arm body 31 near the rib 24. The base 33*a* is provided with a tapered surface inclined in a direction approaching the first connector housing 2 as approaching an end part of the arm body 31 near the one end part 31*a*.

The abutting part 33*b* extends from an end part of the arm body 31 of the base 33*a* near the other end part 31*b* in a direction in which the abutting part 33*b* approaches the first connector housing 2. The abutting part 33*b* is formed in a triangular shape in a plan view and formed in such a manner that the width of the abutting part 33*b* is decreased and the thickness thereof is decreased as the abutting part 33*b* approaches the first connector housing 2. The abutting part 33*b* faces the rib 24 having a distance therebetween. When the first connector housing 2 is pulled in a direction K2 (i.e. in an oblique upper direction; see FIG. 7) crossing the direction in which the locking arm 3 is resiliently deformed, the abutting part 33*b* abuts against the rib 24 so as to prevent the locking arm 3 from being displaced.

As shown in FIG. 10, the second projection 34 is provided on the other end part 31*b* of the arm body 31. The second projection 34 projects from the other end part 31*b* of the arm body 31 toward the outside of the first connector housing 2 (i.e. toward an inner surface of the hole 7*a*).

The second projection 34 and the locking projection 32 are formed in one piece and arranged being lined up along the axial direction of the first connector housing 2. The second projection 34 is provided on the side leaving away from the one end part 31*a* of the arm body 31 compared to the locking projection 32. An amount of projection of the second projection 34 from the arm body 31 is smaller than that of the locking projection 32. When the first connector housing 2 is locked in the hole 7*a* of the body panel 7, the second projection 34 is arranged so as to come in contact with an inner surface of the hole 7*a*, thereby reducing looseness of the connector 1 with respect to the body panel 7.

The second connector housing 4 fits to the first connector housing 2 locked in the hole 7*a* of the body panel 7. As shown in FIG. 1, the second connector housing 4 includes a box-shaped body part 41 receiving a female terminal 42*a*, female hood part 43 covering the body part 41, flange 44, a plurality of full locking arms 5, removal projection 45, and rib 8.

The body part 41 is formed in a box-shape and includes a plurality of terminal receiving chambers 42. Each terminal receiving chamber 42 is formed straight and arranged along the axial direction of the second connector housing 4. The terminal receiving chambers 42 are arranged in parallel to each other.

The female hood part 43 is formed in a hood-shape so as to cover an upper half (i.e. an upper side in FIG. 1) of the body part 41 and formed in a C-shape in section. When the second connector housing 4 fits to the first connector housing 2, an outer wall of the male hood part 22 is positioned between the female hood part 43 and the body part 41.

The flange 44 projects from an outer surface of the body part 41 toward the outside of the body part 41. The flange is provided throughout the entire periphery of an end part of the body part 41. The flange 44 continues to an end part of the female hood part 43. When the second connector housing 4 is locked in the hole 7*a* of the body panel 7, the body panel 7 is positioned between the flange 44 and a full locking projection 52 (explained later) of the full locking arm 5 locked in the hole 7*a*.

The full locking arm 5 is formed on the female hood part 43 and resiliently deformed so as to be locked to an inner edge of the hole 7*a* of the body panel 7. The full locking arm 5 includes an arm body 51 formed on the female hood part 43 and a full locking projection 52 projecting from an outer surface of the arm body 51.

The arm body 51 extends along the axial direction of the second connector housing 4. One end part 51*a* of the arm body 51 located away from the flange 44 continues to an outer surface of the female hood part 43, while another end part 51*b* of the arm body 51 located near the flange 44 is a free end. That is, the arm body 51 extends in a direction leaving away from the first connecter housing 2 which fits to the second connector housing 4. The full locking arm 5 is resiliently deformable in a direction in which the other end part 51*b* of the arm body 51 approaches the female hood part 43.

The full locking projection 52 is provided on the other end part 51*b* of the arm body 51. The full locking projection 52 extends from the other end part 51*b* of the arm body 51 toward the outside of the second connector housing 4. The full locking projection 52 is formed in a triangular shape in its plan view and formed in such a manner that a projecting amount thereof from the arm body 51 decreases as the full locking projection 52 approaches the one end part 51*a* of the arm body 51. When the second connector housing 4 is allowed to pass through the hole 7*a* of the body panel 7, the arm body 51 is resiliently deformed so as to be locked to an inner edge of the hole 7*a* of the body panel 7. Then, the body panel 7 is positioned between the full locking projection 52 and the flange 44.

When the full locking projection 52 is locked to the hole 7*a* of the body panel 7, the full locking arm 5 is locked to an inner edge of the hole 7*a*. When the arm body 51 is resiliently deformed, the full locking arm 5 makes the full locking projection 52 be locked to the hole 7*a* or makes the full locking projection 52 be released from its locking to the hole 7*a*. On an initial condition that the arm body 51 is not resiliently deformed, the full locking projection 52 is locked to the hole 7*a*. When the arm body 51 is resiliently deformed so that the full locking projection 52 is locked to the hole 7*a*, the second connector housing 4 is maintained in the hole 7*a*.

The removal projection 45 is provided in the proximity of the full locking arm 5. The removal projection 45 projects from an outer surface on the lower side (the lower side in FIG. 1) of the female hood part 43 toward the outside of the second connector housing 4 and extends along the axial direction of the second connector housing 4. One end part of the removal projection 45 located away from the flange 44 continues to an outer surface of the female hood part 43, while another end part of the removal projection 45 extends in a direction in which the other end part approaches the flange 44.

The rib 8 is provided on the second connector housing 4. The rib 8 projects from an outer surface of the female hood part 43 toward the outside of the second connector housing 4 and extends along the axial direction of the second connector housing 4. A projecting amount of the rib 8 from the outer surface of the female hood part 43 is about the same as a thickness of the lock part 63 of the locking arm 6. A pair of the ribs 8 is provided in parallel to each other having a distance therebetween. The pair of the ribs 8 is provided having a distance from the flange 44. When the second connector housing 4 fits to the first connector housing 2, the lock arm body 61 is positioned between the pair of the ribs 8, while the lock part 63 is positioned between the pair of the ribs 8 and the flange 44.

The grommet is made of resilient synthetic resin such as rubber and formed in a tube-shape. The grommet positions the second connector housing 4 thereinside. The grommet fits to an outer side of the flange 44 throughout the entire periphery of the second connector housing 4. The grommet covers an end part of the second connector housing 4 near the flange 44.

The grommet allows an electric wire, which is attached to the female terminal fitting 42*a* received in the terminal receiving chamber 42, to pass therethrough. The grommets maintains waterproof characteristic between the electric wire and the grommet so as to prevent water from entering into the terminal receiving chamber 42, that is, from entering into the second connector housing 4.

When the connector 1 is assembled to the body panel 7, first, the first connector housing 2 is permitted to pass through the hole 7*a* of the body panel 7. Then, the locking projection 32 of the locking arm 3 abuts against an outer edge of the hole 7*a* so that the locking arm 3 is resiliently deformed, and when the locking projection 32 passes through the hole 7*a*, the locking arm is resiliently restored to its original state so that the locking projection 32 is locked to the hole 7*a*. Then, the body panel 7 is positioned between the locking projection 32 and the flange 25. The second projection 34 of the locking arm 3 and an inner surface of the hole 7*a* face each other having a small distance therebetween.

At the same time, the projection part 62 of the locking arm 6 abuts against an outer edge of the hole 7*a* so that the locking arm 6 is resiliently deformed, and when the projection part 62 passes through the hole 7*a*, the locking arm 6 is resiliently restored to its original state, so that the body panel 7 is positioned between the projection part 62 and the flange 25. Thus, the first connector housing 2 is locked to and held in the hole 7*a* of the body panel 7. At that time, the first connector housing 2 is held in the hole 7*a* having a certain looseness between the hole 7*a* and the second connector housing 4.

Then, the first connector housing 2 held by the body panel 7 is lightly pulled in a direction K1 (see FIG. 6) reverse to the insertion direction of the first connector housing 2, so that it is confirmed whether or not the first connector housing 2 is securely held in the hole 7*a* of the body panel 7 (i.e. confirmation of assembly). When the first connector housing 2 is securely held in the hole 7*a*, the first connector housing 2 is never pulled out because the locking projection 32 abuts against the body panel 7.

Thereafter, as shown in FIG. 12, the second connector housing 4 equipped with the grommet is allowed to approach the first connector housing 2, which is locked in the hole 7*a*, and the body part 41 of the second connector housing 4 is gradually inserted into the male hood part 22 of the first connector housing 2.

Then, the base 33*a* of the first projection 33 of the locking arm 3 and the removal projection 45 come in contact with each other, so that the locking arm 3 is resiliently deformed in a direction in which the other end part 31*b* of the arm body 31 approaches the male hood part 22. Then, the removal projection 45 removes the locking of the locking arm 3 to the inner edge of the hole 7*a* of the body panel 7.

At that time, rib 8 abuts against the lock part 63 of the locking arm 6, the locking arm 6 is resiliently deformed in a direction in which the lock part 63 leaves the male hood part 22, so that the locking arm 6 climbs on the rib 8. Then, even on a condition that the locking of the locking arm 3 is removed, since the locking arm 6 is resiliently deformed in a direction in which the lock part 63 leaves the male hood part 22, the locking arm 6 prevents the first connector housing 2 from moving relatively with respect to the body panel 7. That is, when the fitting between the first connector housing 2 and the second connector housing 4 is incomplete (i.e. half fitting), the first connector housing 2 cannot move relatively with respect to the body panel 7.

Figure 14:
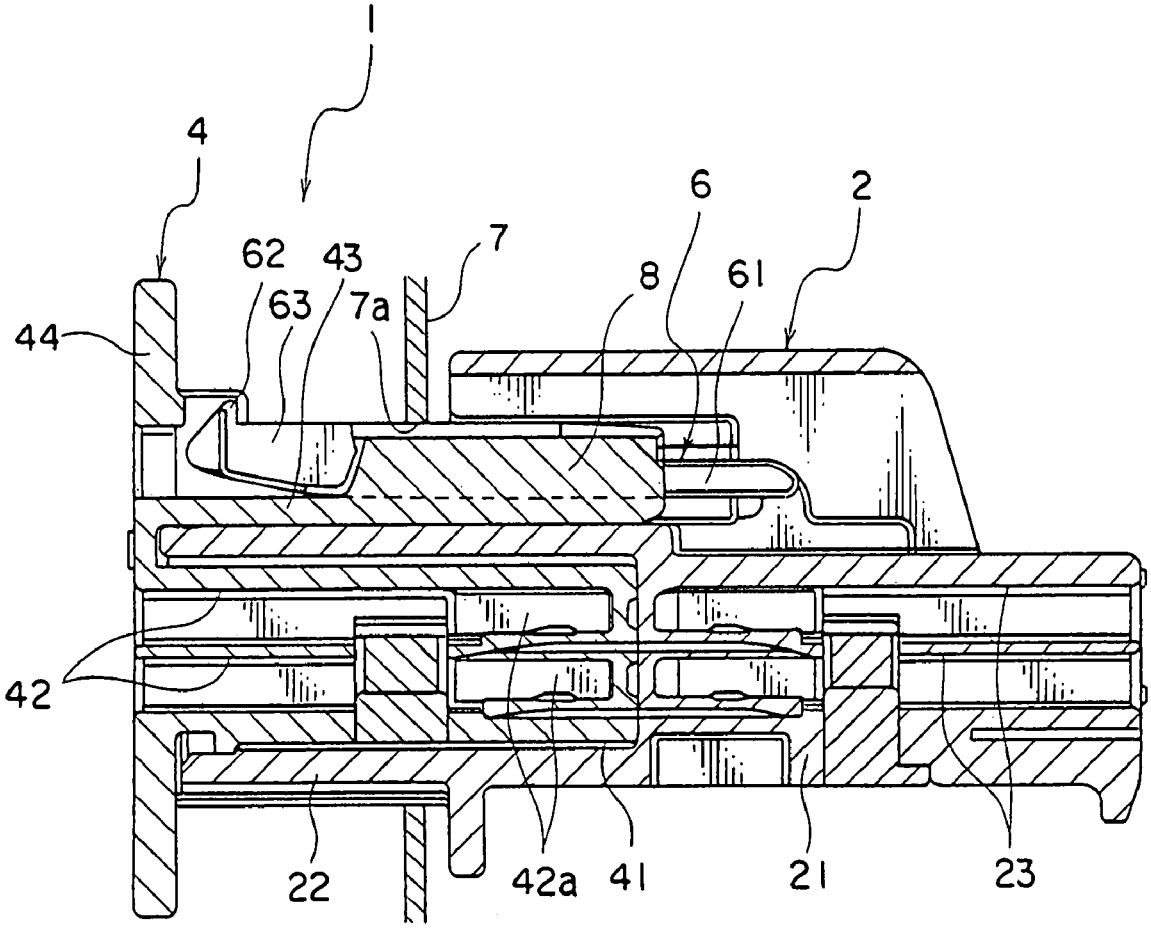
FIG. 14 is a cross sectional view illustrating a state when the first and second connector housings shown in FIG. 13 completely fit to each other.

When the fitting between the first connector housing 2 and the second connector housing 4 is advanced further, the first connector housing 2 and the second connector housing 4 completely fit to each other, as shown in FIG. 14. The removal projection 45 maintains the condition that the locking of the locking arm 3 to the inner edge of the hole 7*a* of the body panel 7 is removed.

The lock part 63 of the locking arm 6 climbs over the rib 8 so as to approach the male hood part 22, so that the locking arm 6 is displaced into a condition that the locking arm 6 is not resiliently deformed. Then, since the locking of the locking arm 6 is removed and the lock part 63 is approaching the male hood part 22, the locking arm permits the first connector housing 2 to move relatively with respect to the body panel 7.

Therefore, when the second connector housing 4 is being fit to the first connector housing 2 locked to the hole 7*a* of the body panel 7, the rib 8 and the locking arm 6 prevent the first connector housing 2 from moving relatively with respect to the body panel 7 until the first connector housing 2 and the second connector housing 4 completely fit to each other. Moreover, the rib 8 and the locking arm 6 permits the first connector housing to move relatively with respect to the body panel 7 when the first connector housing 2 and the second connector housing 4 completely fit to each other.

Figure 15:
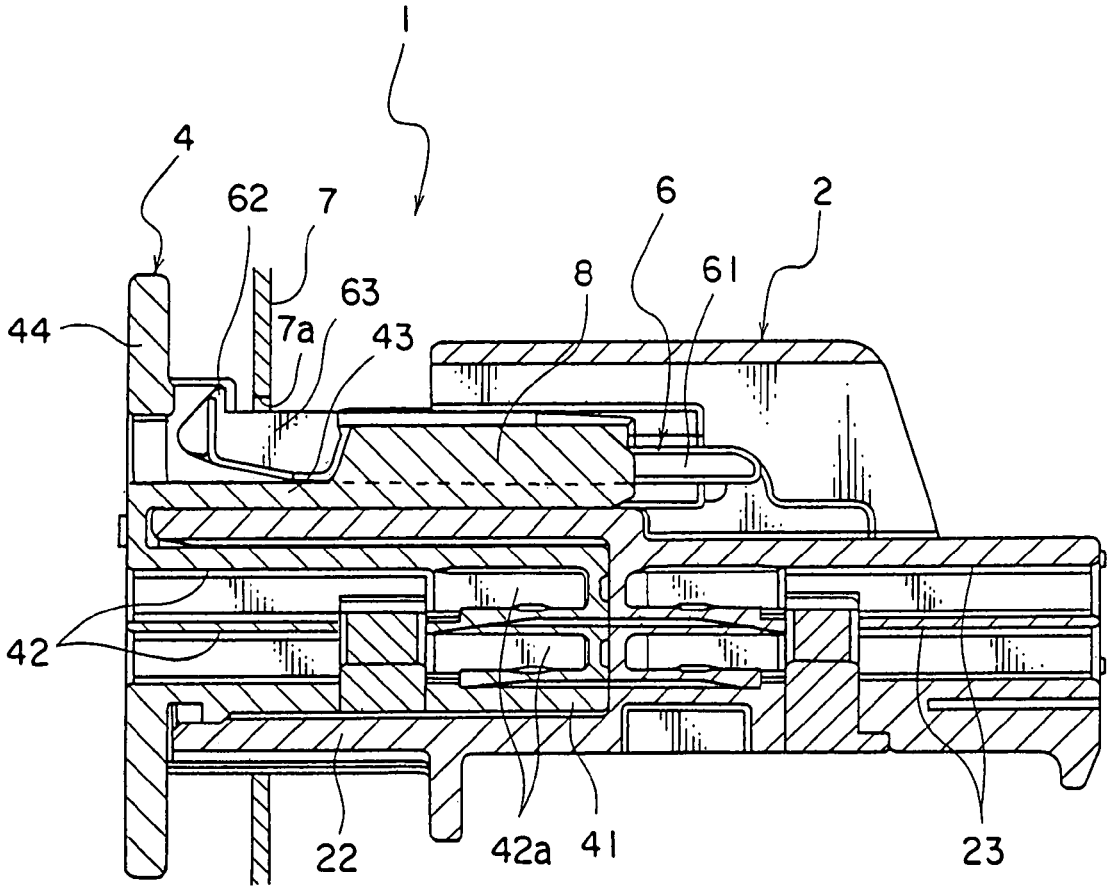
FIG. 15 is a cross sectional view illustrating a state when the second connector housing fit to the first connector housing shown in FIG. 14 is locked to the body panel.
Figure 16:
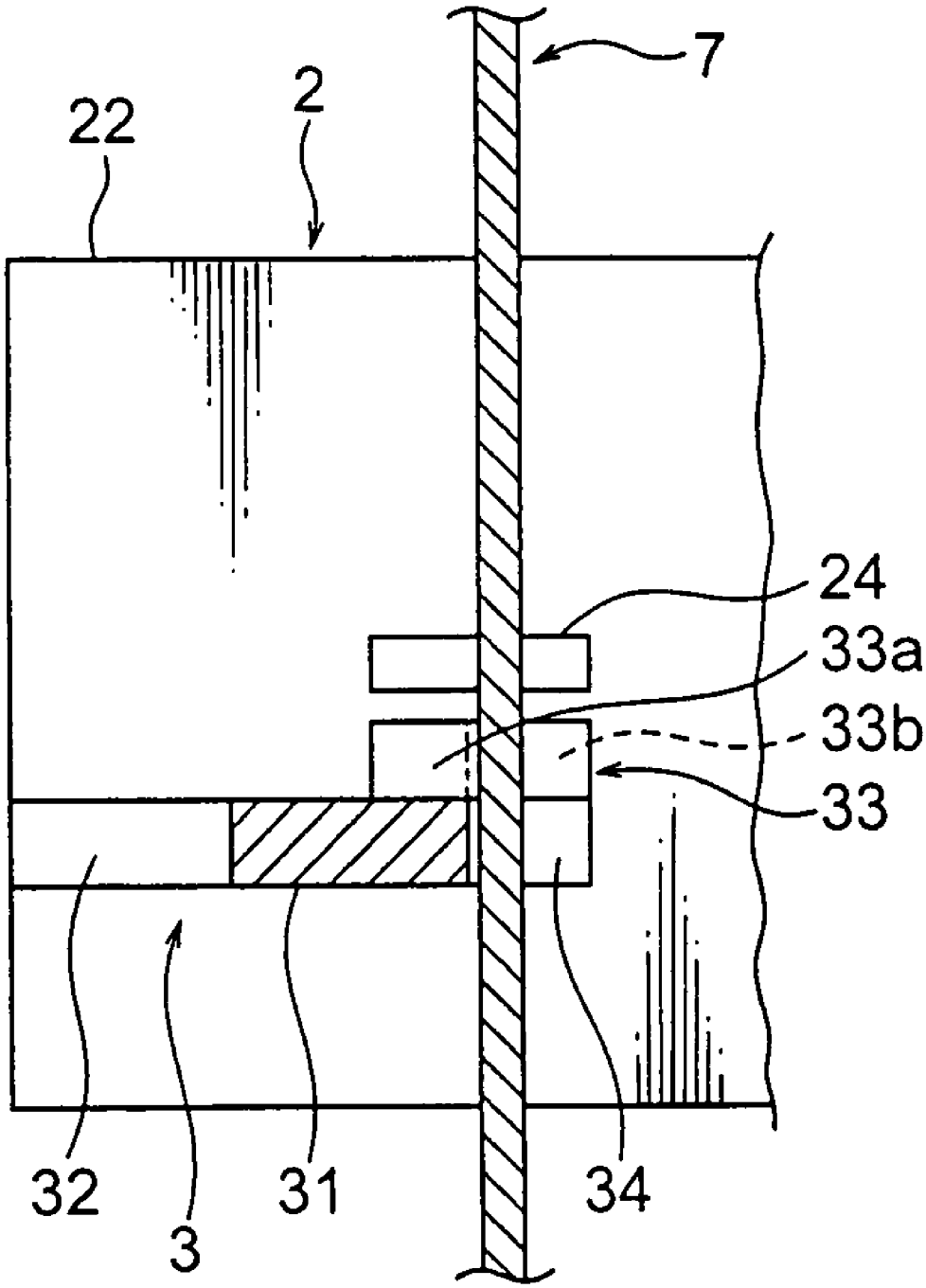
FIG. 16 is a cross sectional view taken along a XVI-XVI line in FIG. 9.
Figure 17:
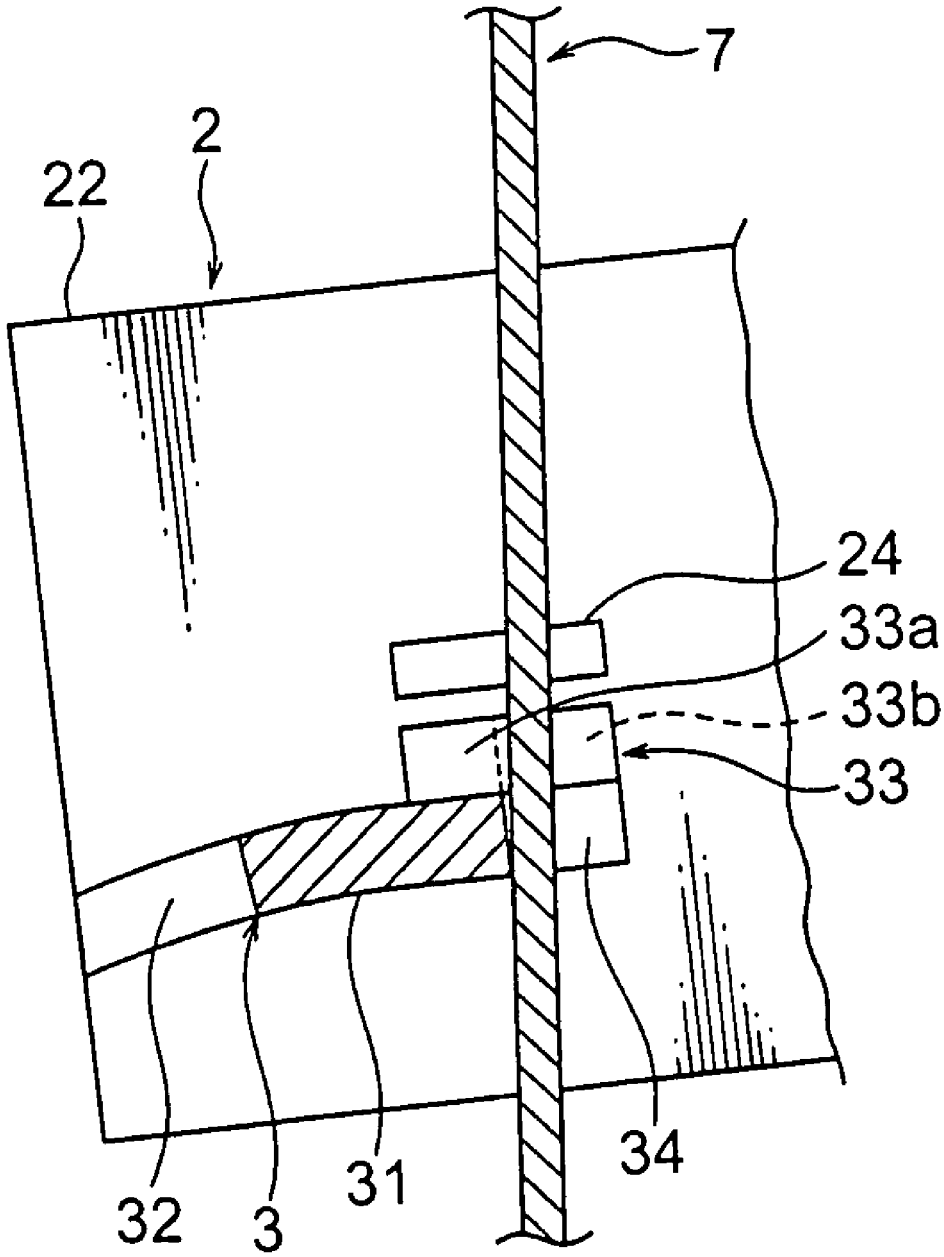
FIG. 17 is a cross sectional view illustrating a state when the locking arm shown in FIG. 16 is displaced.
Figure 18:
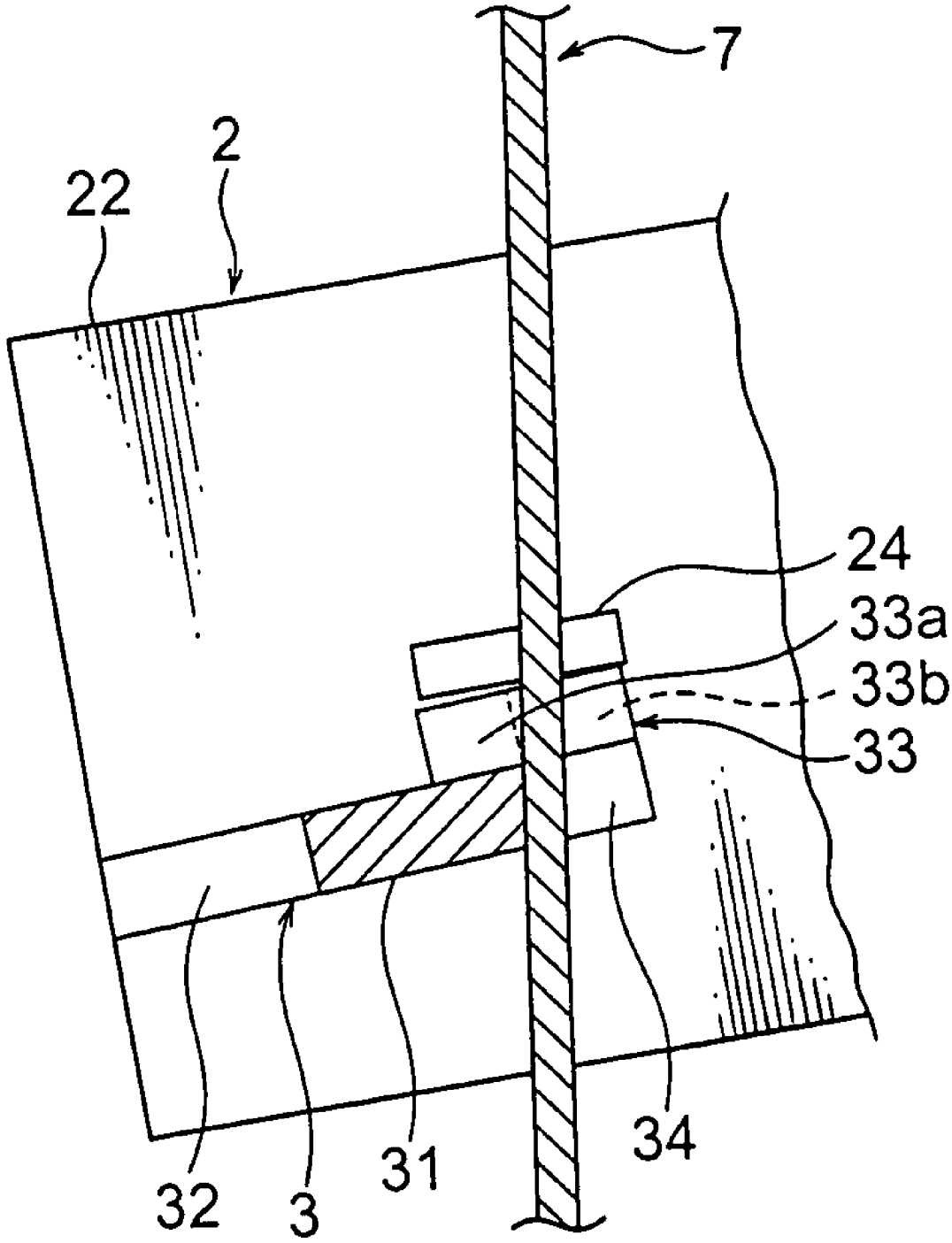
FIG. 18 is a cross sectional view illustrating a state when the locking arm shown in FIG. 17 is further displaced and abuts against a rib.

Then, the first connector housing 4 is pushed toward the body panel 7, that is, the grommet is pushed toward the body panel 7 as shown in FIG. 15. Then, the first connector housing 4 approaches the body panel 7 and comes in contact with the body panel 7, that is, the grommet approaches the body panel 7 and comes in contact with the body panel 7.

Then, as shown in FIG. 1, the full locking projection 52 of the full locking arm 5 is locked in the hole 7*a* of the body panel 7 and the second connector housing 4 is locked in the hole 7*a*, so that the connector 1 is fully fixed to the body panel 7. At that time, the body panel 7 is positioned between the full locking projection 52 and the flange 44 and the body panel 7 is put between the full locking projection 52 and the grommet, so that the second connector housing 4 is fixed to the body panel 7 without looseness, that is, the connector 1 is fixed to the body panel 7 without looseness. At that time, since one end part of the locking arm 6 is pushed by the inner edge of the hole 7*a* of the body panel 7, therefore the connector 1 is further securely fixed to the body panel 7.

Figure 7:
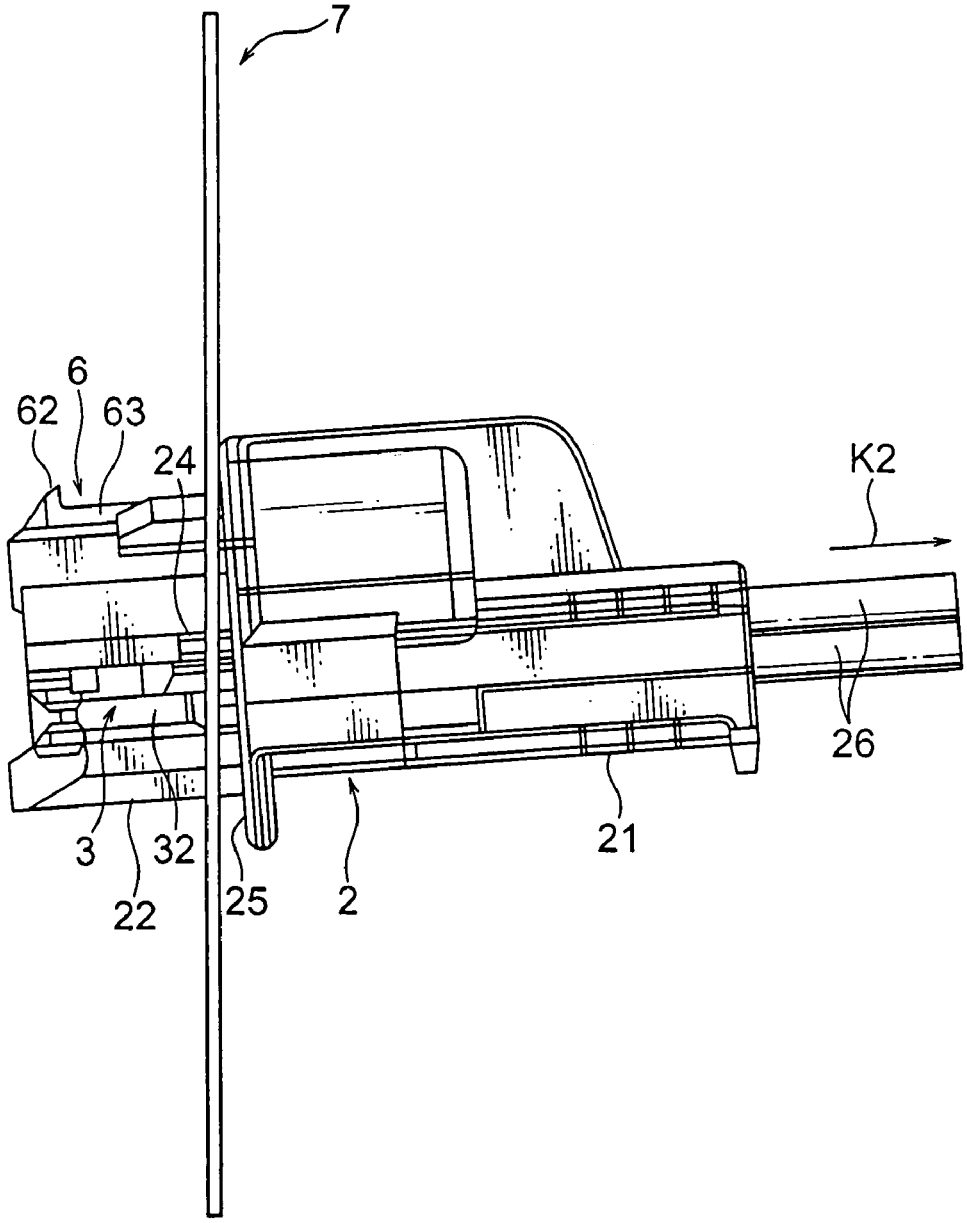
FIG. 7 is a side view illustrating a state when the first connector housing shown in FIG. 6 is pulled in an oblique upper direction.
Figure 8:
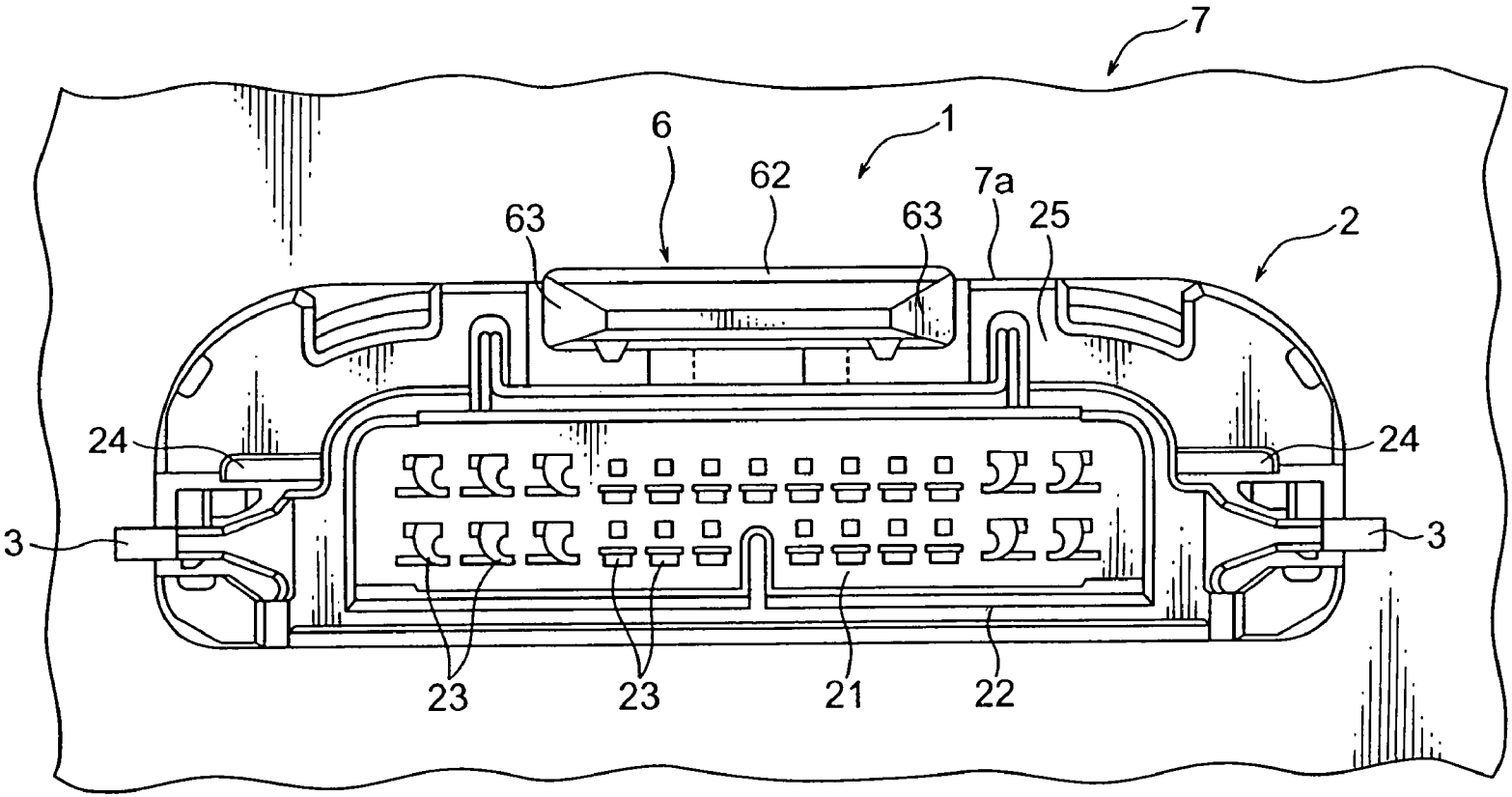
FIG. 8 is a front view of the first connector housing and the body panel shown in FIG. 6.
Figure 9:
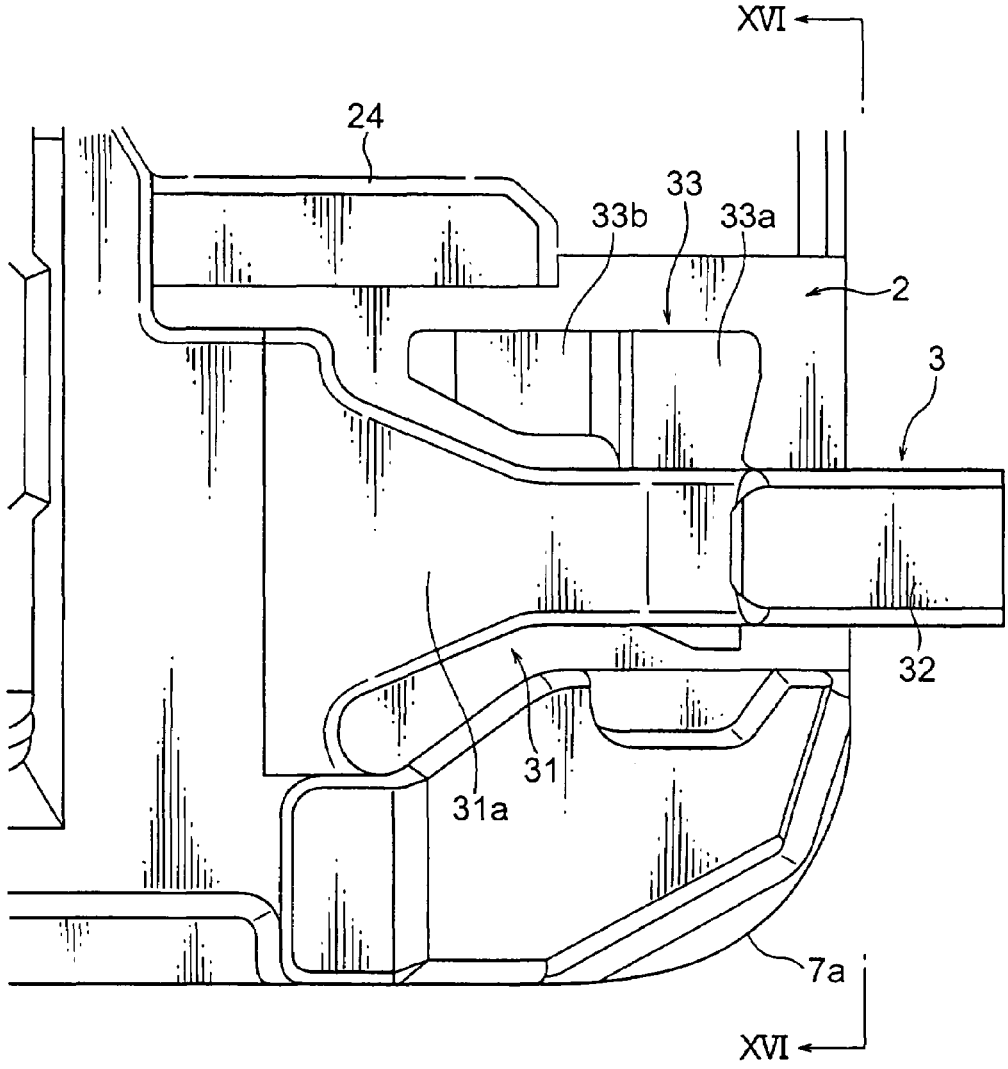
FIG. 9 is an enlarged front view of a primary part of the first connector housing shown in FIG. 8.

In this connection, when the assembly of the first connector housing 2 locked to the hole 7*a* of the body panel 7 is being confirmed (see FIG. 6), due to the looseness between the first connector housing 2 and the hole 7*a* of the body panel 7, it might accidentally happen that the first connector housing 2 is pulled in the direction K2 crossing the direction in which the locking arm 3 is resiliently deformed (see FIG. 7). A relation between the locking arm 3 and the rib 8 in such a case will be explained below with reference to FIGS. 8 and 16-18.

When the first connector housing 2 (see FIG. 16) provisionally locked to the body panel 7 is pulled in the direction K2 crossing the direction in which the locking arm 3 is resiliently deformed, the first connector housing 2 is displaced in the direction K2. Then, the locking arm 3 receives force in the direction K2 on a condition that the locking projection 32 abuts against the body panel 7, and is displaced in a direction in which the locking arm 3 approaches the rib 24 (see FIG. 17). Then, the abutting part 33*b* of the first projection 33 of the locking arm 3 abuts against the rib 24, so that the locking arm 3 is prevented from being displaced (see FIG. 18), that is, the locking arm 3 never receives large stress.

When the first connector housing 2 is locked in the hole 7*a* of the body panel 7, the second projection 34 of the locking arm 3 is positioned so as to come in contact with an inner surface of the hole 7*a*. Therefore, the locking arm 3 is never displaced in a direction in which the locking arm 3 approaches the inner surface of the hole 7*a* and securely displaced in a direction in which the locking arm 3 approaches the rib 24.

According to the preferred embodiment described above, there is provided the rib 24 which prevents the locking arm 3 from being displaced in the direction K2 crossing the direction in which the locking arm 3 is resiliently deformed, therefore the locking arm 3 is prevented from being displaced in the direction K2, so that the locking arm 3 never receives large stress. Therefore, the locking arm 3 can maintain secure holding force without being deformed or damaged, so that the first connector housing 2 is stably held in the hole 7*a* of the body panel 7. That is, the first connector housing 1 can properly fit to the second connector housing 4, so that the male terminal 23*a* and the female terminal 42*a* of the connector housings 2 and 4, respectively, can securely be connected electrically to each other.

Since there is provided the first projection 33, which is provided on the locking arm 3 and projects from the locking arm 3 toward the rib 24, therefore the first projection 33 abuts against the rib 24 so that the locking arm 3 is prevented from being displaced in the direction K2 and the locking arm 3 never receives large stress. Accordingly, the locking arm 3 can maintain further secure holding force without being deformed or damaged, so that the first connector housing 2 is further stably held in the hole 7*a* of the body panel 7.

Since there is provided the second projection 34, which is provided on the locking arm 3 and projects from the locking arm 3 toward an inner surface of the hole 7*a*, therefore the second projection 34 abuts against the inner surface of the hole 7*a* so that the locking arm 3 is prevented from being displaced in a direction in which the locking arm 3 approaches the inner surface of the hole 7*a*, and the locking arm 3 is securely displaced in a direction in which the locking arm 3 approaches the rib 24 and abuts against the rib 24. Accordingly, the locking arm 3 can maintain further secure holding force without being deformed or damaged, so that the first connector housing 2 is further stably held in the hole 7*a* of the body panel 7.

In the preferred embodiment described above, the first projection 33 is provided on the locking arm 3 and projects from the locking arm 3 toward the rib 24. However, instead, in the present invention, the first projection 33 may be provided on the rib 24 and may project from the rib 24 toward the locking arm 3.

The aforementioned preferred embodiments are described to aid in understanding the present invention and variations may be made by one skilled in the art without departing from the spirit and scope of the present invention.

What is claimed is:

1. A connector, in two sections a first connector housing and a second connector housing, the connector comprising:

the first connector housing to be allowed to pass through a hole of a panel;

a locking arm formed on the first connector housing, the locking arm being resiliently deformed to be locked to an inner edge of the hole when the first connector housing is allowed to pass through the hole;

a displacement preventing means, for preventing the locking arm from being displaced, arranged in a direction crossing a direction in which the locking arm is resiliently deformed, said displacement preventing means being provided on the first connector housing, and the second connector housing to be fit to the first connector housing, the second connector housing having a removal means to remove the locking of the locking arm of the first connector housing and a locking projection to lock to the hole;

wherein the locking of the locking arm to the hole is removed when the second connector housing is fit to the first connector housing which is initially locked in the hole, the first connector housing is prevented from moving relatively with respect to the panel until the first and second connector housings are fit to each other, and the first connector housing moves relatively with respect to the panel when the first and second connector housings are fit to each other, so that the second connector housing is subsequently locked in the hole.

2. The connector according to claim 1, further comprising a first projection formed on one of the displacement preventing means and the locking arm, the first projection projecting from the one toward another of the displacement preventing means and the locking arm.

3. The connector according to claim 1, further comprising a second projection formed on the locking arm, the second projection projecting from the locking arm toward an inner surface of the hole.

4. The connector according to claim 2, further comprising a second projection formed on the locking arm, the second projection projecting from the locking arm toward an inner surface of the hole.

* * * * *